US008550595B2

(12) United States Patent
Kaneko

(10) Patent No.: US 8,550,595 B2
(45) Date of Patent: Oct. 8, 2013

(54) INKJET PRINTING APPARATUS AND INKJET PRINTING METHOD

(75) Inventor: Takumi Kaneko, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 208 days.

(21) Appl. No.: 13/176,098

(22) Filed: Jul. 5, 2011

(65) Prior Publication Data

US 2012/0026245 A1 Feb. 2, 2012

(30) Foreign Application Priority Data

Jul. 27, 2010 (JP) ..... 2010-168483

(51) Int. Cl.
*B41J 2/15* (2006.01)
*B41J 2/145* (2006.01)

(52) U.S. Cl.
USPC ..... 347/40; 347/15; 347/37

(58) Field of Classification Search
USPC ..... 347/5, 9–12, 14, 15, 19, 37, 40–43
See application file for complete search history.

(56) References Cited

U.S. PATENT DOCUMENTS 7,438,375 B2 * 10/2008 Arazaki ..... 347/15
7,643,667 B2 * 1/2010 Kusakari ..... 382/149
2005/0253882 A1 * 11/2005 Mizutani et al. ..... 347/9

FOREIGN PATENT DOCUMENTS

JP 2004025627 A 1/2004

* cited by examiner

*Primary Examiner* — Thinh Nguyen
(74) *Attorney, Agent, or Firm* — Fitzpatrick, Cella, Harper & Scinto

(57) ABSTRACT

In an inkjet printing apparatus, degraded image quality due to ink viscosity increasing is suppressed without forming ink dots unrelated to the print image as in what is called on-sheet preliminary ejection. More specifically, print data is generated for each pass in a multi-pass printing, such that the ratio of dots continuously formed by the same nozzle during the same scan becomes greater in low-duty areas than in high-duty areas. Thus, the lengthening of nozzle nonuse time can be suppressed, even in the case of printing a low-duty area. As a result, it becomes possible to suppress degraded image quality due to ink viscosity increasing.

7 Claims, 21 Drawing Sheets

FIG.5A 0sec
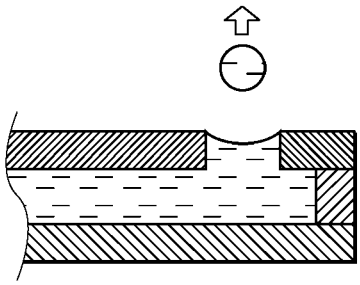
FIG.5B 0.3sec
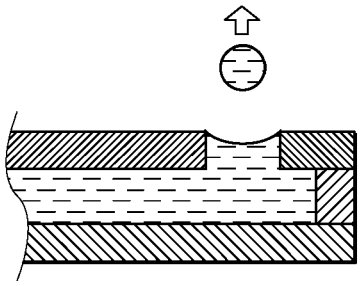
FIG.5C 0.6sec
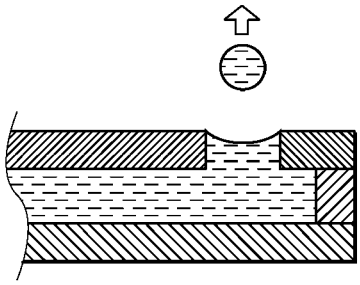
FIG.5D 1.0sec
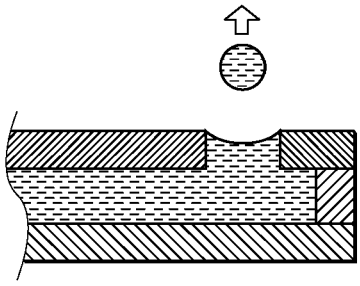
FIG.5E 1.2sec
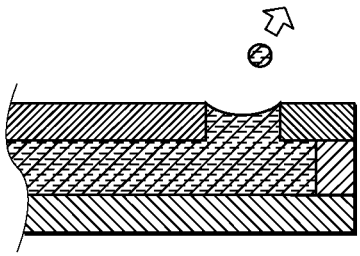

| | | | | | | | | | | | | | | | |
|---|---|---|---|---|---|---|---|---|---|---|---|---|---|---|---|
| 8 | 7 | 6 | 5 | 8 | 7 | 6 | 5 | 8 | 7 | 6 | 5 | 8 | 7 | 6 | 5 |
| 4 | 3 | 2 | 1 | 4 | 3 | 2 | 1 | 4 | 3 | 2 | 1 | 4 | 3 | 2 | 1 |
| 5 | 8 | 7 | 6 | 5 | 8 | 7 | 6 | 5 | 8 | 7 | 6 | 5 | 8 | 7 | 6 |
| 1 | 4 | 3 | 2 | 1 | 4 | 3 | 2 | 1 | 4 | 3 | 2 | 1 | 4 | 3 | 2 |

| GRADATION DATA | NUMBER OF DOTS | DOT ARRANGEMENT |
|---|---|---|
| 0000 | 0 | |
| 0001 | 1 | |
| 0010 | 2 | |
| 0011 | 3 | |
| 0100 | 4 | |
| 0101 | 5 | |
| 0110 | 6 | |
| 0111 | 7 | |
| 1000 | 8 | |

FIG.8

0010

| | | | | | | | | | | | | | | | |
|---|---|---|---|---|---|---|---|---|---|---|---|---|---|---|---|
| ○ | | ○ | | | | | | | ○ | | ○ | | | | |
| | | | | ○ | | ○ | | | | | | | ○ | | ○ |
| | | | | ○ | | ○ | | | | | | | ○ | | ○ |
| ○ | | ○ | | | | | | | ○ | | ○ | | | | |

0%

FIG.10A

0010

| | | | | | | | | | | | | | | | |
|---|---|---|---|---|---|---|---|---|---|---|---|---|---|---|---|
| 8 | | 6 | | | | | | | 7 | | 5 | | | | |
| | | | | 4 | | 2 | | | | | | | 3 | | 1 |
| | | | | 5 | | 7 | | | | | | | 8 | | 6 |
| 1 | | 3 | | | | | | | 4 | | 2 | | | | |

0%

FIG.10B

1000

| | | | | | | | | | | | | | | | |
|---|---|---|---|---|---|---|---|---|---|---|---|---|---|---|---|
| 8 | 7 | 6 | 5 | 8 | 7 | 6 | 5 | 8 | 7 | 6 | 5 | 8 | 7 | 6 | 5 |
| 4 | 3 | 2 | 1 | 4 | 3 | 2 | 1 | 4 | 3 | 2 | 1 | 4 | 3 | 2 | 1 |
| 5 | 8 | 7 | 6 | 5 | 8 | 7 | 6 | 5 | 8 | 7 | 6 | 5 | 8 | 7 | 6 |
| 1 | 4 | 3 | 2 | 1 | 4 | 3 | 2 | 1 | 4 | 3 | 2 | 1 | 4 | 3 | 2 |

FIG.11

MASK B

| | | | | | | | | | | | | | | | |
|---|---|---|---|---|---|---|---|---|---|---|---|---|---|---|---|
| 4 | 3 | 2 | 1 | 4 | 3 | 2 | 1 | 4 | 3 | 2 | 1 | 4 | 3 | 2 | 1 |
| 7 | 6 | 5 | 8 | 7 | 6 | 5 | 8 | 7 | 6 | 5 | 8 | 7 | 6 | 5 | 8 |
| 3 | 2 | 1 | 4 | 3 | 2 | 1 | 4 | 3 | 2 | 1 | 4 | 3 | 2 | 1 | 4 |
| 8 | 7 | 6 | 5 | 8 | 7 | 6 | 5 | 8 | 7 | 6 | 5 | 8 | 7 | 6 | 5 |

MASK C

| | | | | | | | | | | | | | | | |
|---|---|---|---|---|---|---|---|---|---|---|---|---|---|---|---|
| 6 | 5 | 8 | 7 | 6 | 5 | 8 | 7 | 6 | 5 | 8 | 7 | 6 | 5 | 8 | 7 |
| 2 | 1 | 4 | 3 | 2 | 1 | 4 | 3 | 2 | 1 | 4 | 3 | 2 | 1 | 4 | 3 |
| 7 | 6 | 5 | 8 | 7 | 6 | 5 | 8 | 7 | 6 | 5 | 8 | 7 | 6 | 5 | 8 |
| 3 | 2 | 1 | 4 | 3 | 2 | 1 | 4 | 3 | 2 | 1 | 4 | 3 | 2 | 1 | 4 |

MASK D

| | | | | | | | | | | | | | | | |
|---|---|---|---|---|---|---|---|---|---|---|---|---|---|---|---|
| 2 | 1 | 4 | 3 | 2 | 1 | 4 | 3 | 2 | 1 | 4 | 3 | 2 | 1 | 4 | 3 |
| 5 | 8 | 7 | 6 | 5 | 8 | 7 | 6 | 5 | 8 | 7 | 6 | 5 | 8 | 7 | 6 |
| 1 | 4 | 3 | 2 | 1 | 4 | 3 | 2 | 1 | 4 | 3 | 2 | 1 | 4 | 3 | 2 |
| 6 | 5 | 8 | 7 | 6 | 5 | 8 | 7 | 6 | 5 | 8 | 7 | 6 | 5 | 8 | 7 |

FIG.13

| | | | | | | | | | | | | | | | |
|---|---|---|---|---|---|---|---|---|---|---|---|---|---|---|---|
| 1 | 2 | 3 | 4 | 1 | 2 | 3 | 4 | 1 | 2 | 3 | 4 | 1 | 2 | 3 | 4 |
| 1 | 2 | 3 | 4 | 1 | 2 | 3 | 4 | 1 | 2 | 3 | 4 | 1 | 2 | 3 | 4 |
| 1 | 2 | 3 | 4 | 1 | 2 | 3 | 4 | 1 | 2 | 3 | 4 | 1 | 2 | 3 | 4 |
| 1 | 2 | 3 | 4 | 1 | 2 | 3 | 4 | 1 | 2 | 3 | 4 | 1 | 2 | 3 | 4 |

FIG.15A

| | | | | | | | | | | | | | | | |
|---|---|---|---|---|---|---|---|---|---|---|---|---|---|---|---|
| 4 | 2 | 3 | 1 | 1 | 2 | 3 | 4 | 4 | 2 | 3 | 1 | 1 | 2 | 3 | 4 |
| 1 | 2 | 3 | 4 | 4 | 2 | 3 | 1 | 1 | 2 | 3 | 4 | 4 | 2 | 3 | 1 |
| 2 | 3 | 4 | 1 | 1 | 3 | 4 | 2 | 2 | 3 | 4 | 1 | 1 | 3 | 4 | 2 |
| 1 | 2 | 3 | 4 | 2 | 3 | 4 | 1 | 1 | 2 | 3 | 4 | 2 | 3 | 4 | 1 |

FIG.15B

0010

| | | | | | | | | | | | | | | | |
|---|---|---|---|---|---|---|---|---|---|---|---|---|---|---|---|
| 1 | | | | 1 | | | | 1 | | | | 1 | | | |
| | | 3 | | | | 3 | | | | 3 | | | | 3 | |
| | 2 | | | | 2 | | | | 2 | | | | 2 | | |
| | | | 4 | | | | 4 | | | | 4 | | | | 4 |

FIG.16

| | | | | | | | |
|---|---|---|---|---|---|---|---|
| 1 | 139 | 187 | 155 | 9 | 143 | 191 | 159 |
| 171 | 33 | 65 | 91 | 175 | 37 | 69 | 95 |
| 123 | 107 | 17 | 219 | 127 | 111 | 21 | 223 |
| 235 | 203 | 251 | 49 | 239 | 207 | 254 | 53 |
| 13 | 147 | 180 | 163 | 5 | 151 | 135 | 167 |
| 179 | 41 | 73 | 99 | 183 | 45 | 77 | 103 |
| 131 | 115 | 25 | 227 | 64 | 119 | 29 | 231 |
| 243 | 211 | 195 | 57 | 247 | 215 | 199 | 61 |
FIG.18A
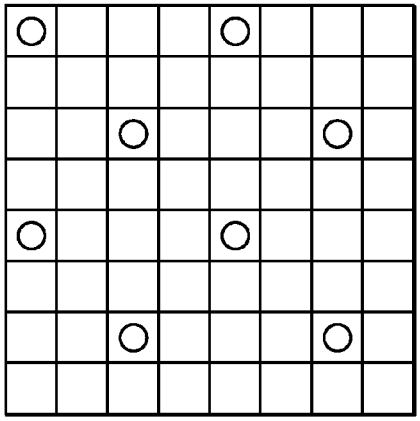
FIG.18B
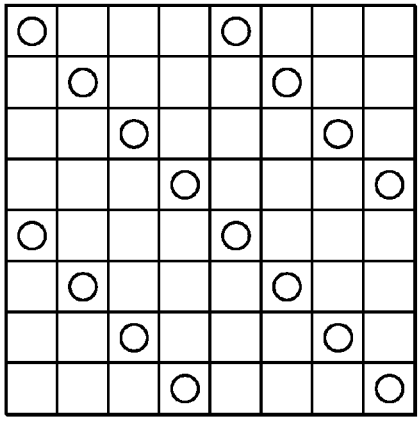
FIG.18C
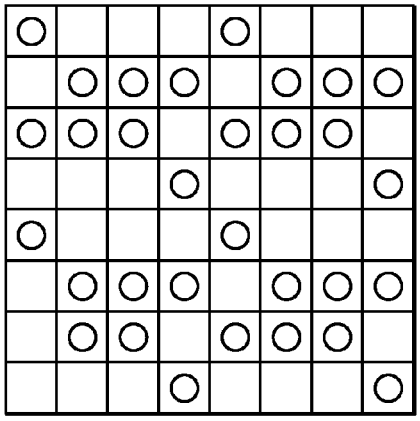
FIG.18D
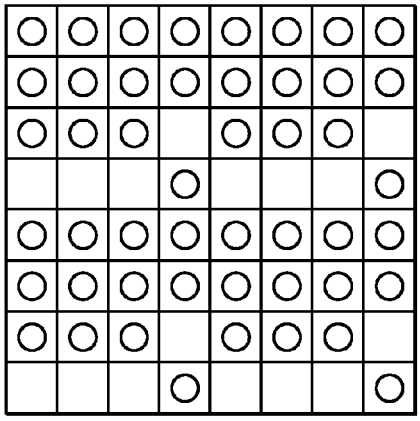
FIG.18E

FIG.19A

| | | | | | | | | | | | | | | | |
|---|---|---|---|---|---|---|---|---|---|---|---|---|---|---|---|
| 8 | 7 | 6 | 5 | 8 | 7 | 6 | 5 | 8 | 7 | 6 | 5 | 8 | 7 | 6 | 5 |
| 4 | 3 | 2 | 1 | 4 | 3 | 2 | 1 | 4 | 3 | 2 | 1 | 4 | 3 | 2 | 1 |
| 5 | 8 | 7 | 6 | 5 | 8 | 7 | 6 | 5 | 8 | 7 | 6 | 5 | 8 | 7 | 6 |
| 1 | 4 | 3 | 2 | 1 | 4 | 3 | 2 | 1 | 4 | 3 | 2 | 1 | 4 | 3 | 2 |
| 8 | 7 | 6 | 5 | 8 | 7 | 6 | 5 | 8 | 7 | 6 | 5 | 8 | 7 | 6 | 5 |
| 4 | 3 | 2 | 1 | 4 | 3 | 2 | 1 | 4 | 3 | 2 | 1 | 4 | 3 | 2 | 1 |
| 5 | 8 | 7 | 6 | 5 | 8 | 7 | 6 | 5 | 8 | 7 | 6 | 5 | 8 | 7 | 6 |
| 1 | 4 | 3 | 2 | 1 | 4 | 3 | 2 | 1 | 4 | 3 | 2 | 1 | 4 | 3 | 2 |

| | | | | | | | |
|---|---|---|---|---|---|---|---|
| 8 | | | | 8 | | | |
| | | | | | | | |
| | | 7 | | | | 7 | |
| | | | | | | | |
| 8 | | | | 8 | | | |
| | | | | | | | |
| | | 7 | | | | 7 | |
| | | | | | | | |

FIG.19B CONTINUITY RATIO 100%

| | | | | | | | |
|---|---|---|---|---|---|---|---|
| 8 | | | | 8 | | | |
| | 3 | | | | 3 | | |
| | | 7 | | | | 7 | |
| | | | 2 | | | | 2 |
| 8 | | | | 8 | | | |
| | 3 | | | | 3 | | |
| | | 7 | | | | 7 | |
| | | | 2 | | | | 2 |

FIG.19C CONTINUITY RATIO 100%

| | | | | | | | |
|---|---|---|---|---|---|---|---|
| 8 | | | | 8 | | | |
| | 3 | 2 | 1 | | 3 | 2 | 1 |
| 5 | 8 | 7 | | 5 | 8 | 7 | |
| | | | 2 | | | | 2 |
| 8 | | | | 8 | | | |
| | 3 | 2 | 1 | | 3 | 2 | 1 |
| | 8 | 7 | | 5 | 8 | 7 | |
| | | | 2 | | | | 2 |

FIG.19D CONTINUITY RATIO 17%

| | | | | | | | |
|---|---|---|---|---|---|---|---|
| 8 | 7 | 6 | 5 | 8 | 7 | 6 | 5 |
| 4 | 3 | 2 | 1 | 4 | 3 | 2 | 1 |
| 5 | 8 | 7 | | 5 | 8 | 7 | |
| | | | 2 | | | | 2 |
| 8 | 7 | 6 | 5 | 8 | 7 | 6 | 5 |
| 4 | 3 | 2 | 1 | 4 | 3 | 2 | 1 |
| 5 | 8 | 7 | | 5 | 8 | 7 | |
| | | | 2 | | | | 2 |

FIG.19E CONTINUITY RATIO 5%

INKJET PRINTING APPARATUS AND INKJET PRINTING METHOD

BACKGROUND OF THE INVENTION

1. Field of the Invention

The present invention relates to an inkjet printing apparatus and an inkjet printing method, and more particularly relates to a system for suppressing ejection failure due to ink viscosity increasing in a nozzle of a print head.

2. Description of the Related Art

With print heads that eject ink, it is known that ejection failure such as deviations in the ejection direction and variation in ejection volumes may occur due to ink viscosity increasing inside nozzles. Decreases in ink droplet sizes and diversification in ink color materials in connection with recent improvements in print image quality have made such ejection failure occur more readily.

Since a large variety of images are printed by printers, there are cases where, depending on the print image, some nozzles are not used for comparatively long amounts of time during a printing operation. Ink viscosity increasing readily occurs in such unused nozzles, and an ejection failure occurs more readily as a result. Particularly, with large-sized inkjet printers, since it takes a comparatively long time (1 sec, for example) to cause a print head to scan from one end of a print medium to the other end, nozzle nonuse time becomes longer. Consequently, the ejection failure occurs readily with such printers.

Particularly, with multi-pass printing techniques that perform printing by a plurality of scans of a print head over the same pixel line in a scan direction, since the print data to be printed onto a single pixel line is distributed across plural scans, the frequency of ejection from a nozzle corresponding to that pixel line during a single scan decreases. For this reason, the ejection failure as discussed above occurs even more readily with multi-pass printing.

In order to prevent such ejection failure from occurring, a preliminary ejection is performed in many printers. Specifically, an ink receiving member is provided in a non-printing area of a printing apparatus, a given number of times of preliminary ejection are performed from respective nozzles of a print head into the ink receiving member at fixed intervals or at required timings and the ink inside the nozzles is refreshed. Thus, even if there exists some ink of viscosity increasing, it is discharged from the nozzles, and ink viscosity inside the nozzles can be kept normal.

In order to prevent the occurrence of the ejection failure by applying such typically performed preliminary ejection to nozzles that go unused during printing as described earlier, it is conceivable to shorten the preliminary ejection interval. There are methods for increasing the preliminary ejection frequency as one form of shortening the interval, but this incurs a derivative problem in that the overall printing throughput lowers in such cases.

Another preliminary ejection technique is known besides preliminary ejection performed to an ink receiving member as described above. This technique, called on-sheet preliminary ejection, involves ejecting ink onto a print medium on the basis of data that is unrelated to the print data (for example, see Japanese Patent Laid-Open No. 2004-025627). According to this technique, even in cases where there exist nozzles that go unused for comparatively long amounts of time depending on the print data, the on-sheet preliminary ejection can be performed during printing operation for those nozzles. Thus, it becomes possible to suppress ink viscosity increasing.

However, performing preliminary ejection onto a print medium basically means that ink dots unrelated to the image that is originally supposed to be printed will be formed among the printed matter, and lowered quality of the print image is unavoidable in some cases. Particularly, with multi-pass printing, the possibility basically increases that on-sheet preliminary ejection will be performed during each of a plurality of scans across the same pixel line of the scan direction, as described earlier. Furthermore, in the case of printing an image of comparatively low density, the ejection frequency during a single scan lowers and the ink ejection interval becomes longer, and thus the necessity of on-sheet preliminary ejection increases. For this reason, in the case of printing an image of comparatively low density with a multi-pass printing technique, the reduction in the quality of the print image due to on-sheet preliminary ejection becomes significant.

SUMMARY OF THE INVENTION

An object of the present invention is to provide an inkjet printing apparatus and an inkjet printing method that are able to suppress degraded image quality due to ink viscosity increasing without forming ink dots unrelated to an image that should be printed.

In a first aspect of the present invention, there is provided an ink jet printing apparatus that performs plural scans of a print head, which has a plurality of nozzles for ejecting ink, over pixel line areas on a print medium and is able to form dots on the pixel line areas with the plural scans, the apparatus comprising: a generation unit configured to generate print data used for each of the plural scans based on print data corresponding to dots to be formed on the pixel line area, so that a ratio of dots that are continuously formed on the pixel line area by a same nozzle in a same scan, out of dots formed for low density image area having densities equal to or lower than a predetermined density is higher than a ratio of dots that are continuously formed on the pixel line area by a same nozzle in a same scan, out of dots formed for high density image area having densities higher than the predetermined density.

In a second aspect of the present invention, there is provided an ink jet printing method of performing plural scans of a print head, which has a plurality of nozzles for ejecting ink, over pixel line areas on a print medium and of forming dots on the pixel line areas with the plural scans, the method comprising the steps of: a generation step of generating print data used for each of the plural scans based on print data corresponding to dots to be formed on the pixel line area, so that a ratio of dots that are continuously formed on the pixel line area by a same nozzle in a same scan, out of dots formed for low density image area having densities equal to or lower than a predetermined density is higher than a ratio of dots that are continuously formed on the pixel line area by a same nozzle in a same scan, out of dots formed for high density image area having densities higher than the predetermined density; and a forming step of forming dots on the pixel line area with the plural scans according to the print data generated in the generation step.

According to the above configuration, the lengthening of nozzle nonuse time during print head scanning can be suppressed, even in the case of printing a low-density image. As a result, it becomes possible to suppress degraded image quality due to ink viscosity increasing without forming ink dots unrelated to a print image.

Further features of the present invention will become apparent from the following description of exemplary embodiments (with reference to the attached drawings).

BRIEF DESCRIPTION OF THE DRAWINGS

FIGS. 5A to 5E are views explaining how an ejection failure occurs due to ink viscosity increasing;

FIG. 8 is a diagram illustrating exemplary index patterns in accordance with an embodiment of the present invention;

FIG. 10A is a diagram illustrating an exemplary index pattern that is weakly attuned with the mask illustrated in FIGS. 7A and 7B;

FIG. 10B is a diagram illustrating an arrangement of dots and scan cycles that form those dots when using the index pattern illustrated in FIG. 10A;

FIG. 11 is a diagram illustrating the relationship between an arrangement of dots and passes (scan cycles) that form those dots in the case of printing an image with 100% duty;

FIG. 13 is a diagram explaining masks in accordance with a second embodiment of the present invention;

FIG. 15A is a diagram illustrating, similarly to the mask pattern discussed above, the results of determining which scans form dots by sampling, using a fixed sampling pattern in accordance with a fourth embodiment of the present invention;

FIG. 15B is a diagram illustrating an exemplary irregular mask that determines a dot arrangement such that dots formed at a fixed interval are formed by the same scan like in the above;

FIG. 16 is a diagram illustrating the results of distributing the dots given by the pattern illustrated in FIG. 15A among multi-stage scans;

FIGS. 18A to 18E are diagrams explaining a dither process in accordance with a fifth embodiment of the present invention;

FIG. 19A is a diagram illustrating a mask used in the present embodiment for this dot arrangement;

FIGS. 19B to 19E are diagrams illustrating dots distributed among respective scans using the above mask;

DESCRIPTION OF THE EMBODIMENTS

Hereinafter, embodiments of the present invention will be described in detail and with reference to the drawings.

Figure 1:
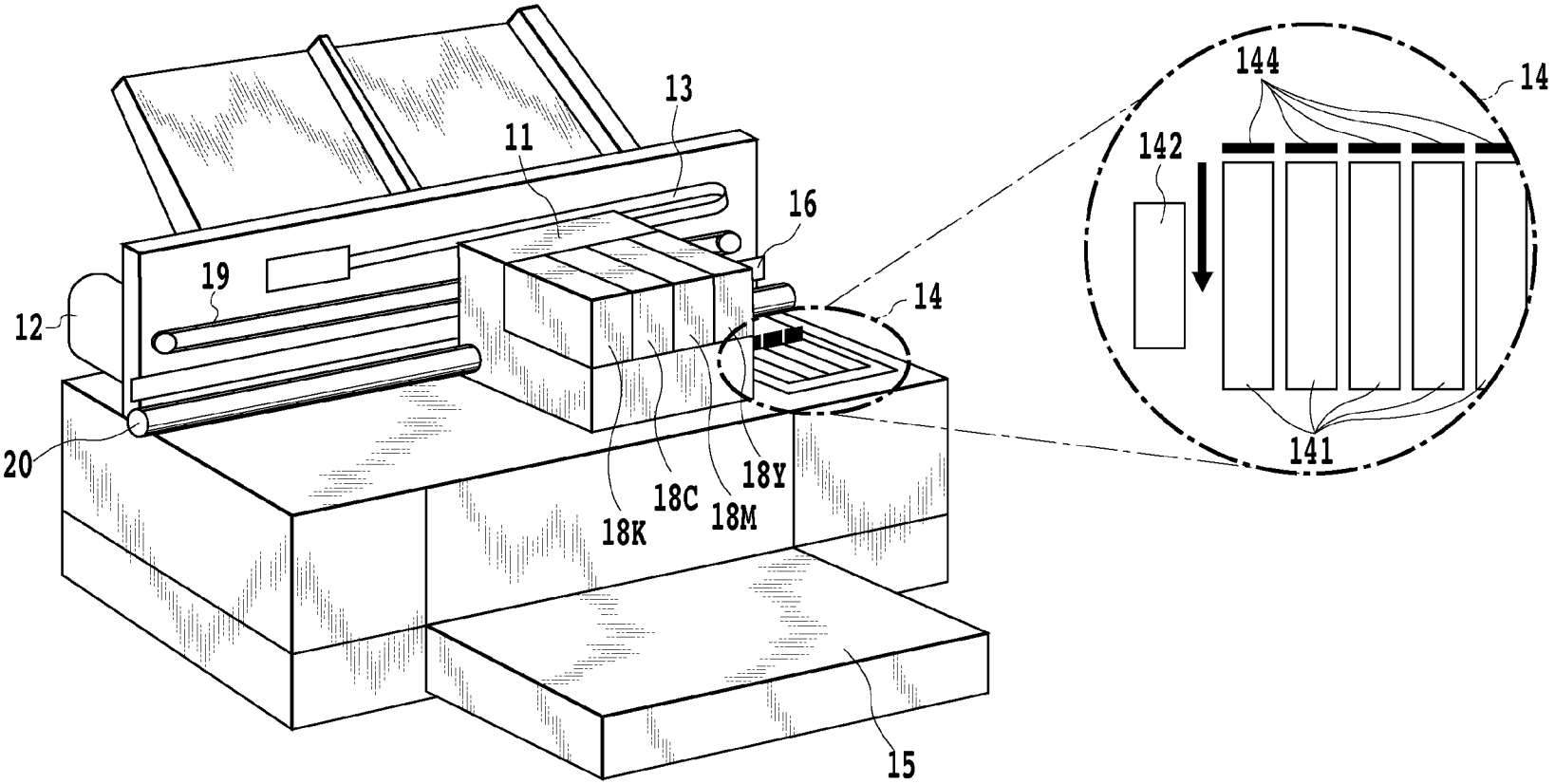
FIG. 1 is a view illustrating a schematic configuration of an inkjet printer to which the present invention can be applied.

FIG. 1 is a view illustrating a schematic configuration of an inkjet printer, being an embodiment of an inkjet printing apparatus of the present invention. A carriage 11 is removably equipped with respective ink tanks 18Y, 18M, 18C, and 18Bk storing yellow (Y), magenta (M), cyan (C), and black (Bk). Respective print heads (not illustrated) that eject the above four types of ink are provided on the underside of the carriage 11. The carriage 11 is slidably guided by a guide shaft 20, while also being subjected to the driving force of a carriage motor 12 by the transmission mechanism of a pulley and belt 19. Thus, the carriage 11 is able to move along the guide shaft 20. A print head scan is performed by this movement of the carriage 11, and ink is ejected from the print heads during the scan. The movement of the carriage 11 can be detected using an optical position sensor 16. A print (ejection) signal and other information are sent from the apparatus main body to the print heads and ink tanks mounted on the carriage 11 via a flexible cable 13. A feed tray 15 stocks print media, herein taken to be paper sheets, in a stacked state, and feeds one sheet at a time towards a print area given by the print heads. Between successive scans of the print heads, a print medium fed by the feed tray 15 is conveyed a predetermined amount by conveying rollers not illustrated. By repeatedly conveying a print medium and performing the scan of the print heads in this way, one sheet of a print medium is successively printed upon.

At one end of the movement range of the carriage 11, there is a provided a recovery mechanism 14 that performs an ejection recovery process for maintaining a favorable print head ejection state. Reference numeral 141 denotes caps that cover the face upon which nozzles (ejection openings) are arranged on each print head (the nozzle face). Reference 142 denotes an ink receiving member that receives inks ejected during a preliminary ejection operation. Also, reference 144 denotes wiper blades for wiping the nozzle faces of the print heads, which can wipe the nozzle faces while moving in the direction of the arrow in the drawing. Herein, the present invention reduces ejection failure by suppressing the presence of nozzles that go unused for a comparatively long time, as shall be made clear from the respective embodiments discussed hereinafter. However, by providing the ejection recovery mechanism discussed above, it is possible to prevent ejection failure due to various factors, including ejection failure due to nozzles going unused for long times as above.

Figure 2:
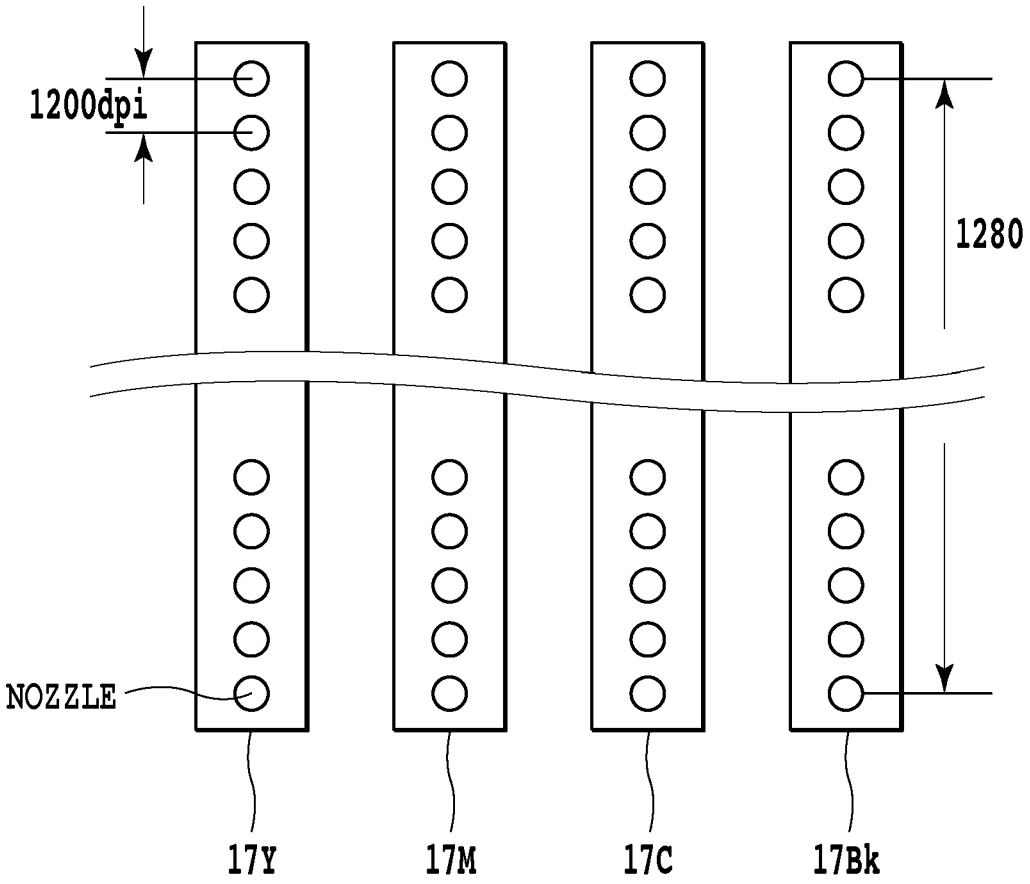
FIG. 2 is a schematic view of the print heads illustrated in FIG. 1 as viewed from the side of the face upon which nozzles are arrayed.

FIG. 2 is a schematic diagram illustrating the print head nozzle faces described above. In a printer of the present embodiment, print heads 17Y, 17M, 17C, and 17Bk for Y, M, C, and Bk ink are used as described above. Each print head has a nozzle line wherein 1280 nozzles 41 are arranged at a density of 1200 per inch. The volume of ink droplets ejected from each of the nozzles of the respective print heads 17Y, 17M, and 17C is uniformly 4.5 pl (pico-liters). In contrast, the volume of ink droplets ejected from each of the nozzles of the print head 17Bk is greater than the above volume (approximately 4.5 pl) in order to realize the high density of black.

Figure 3:
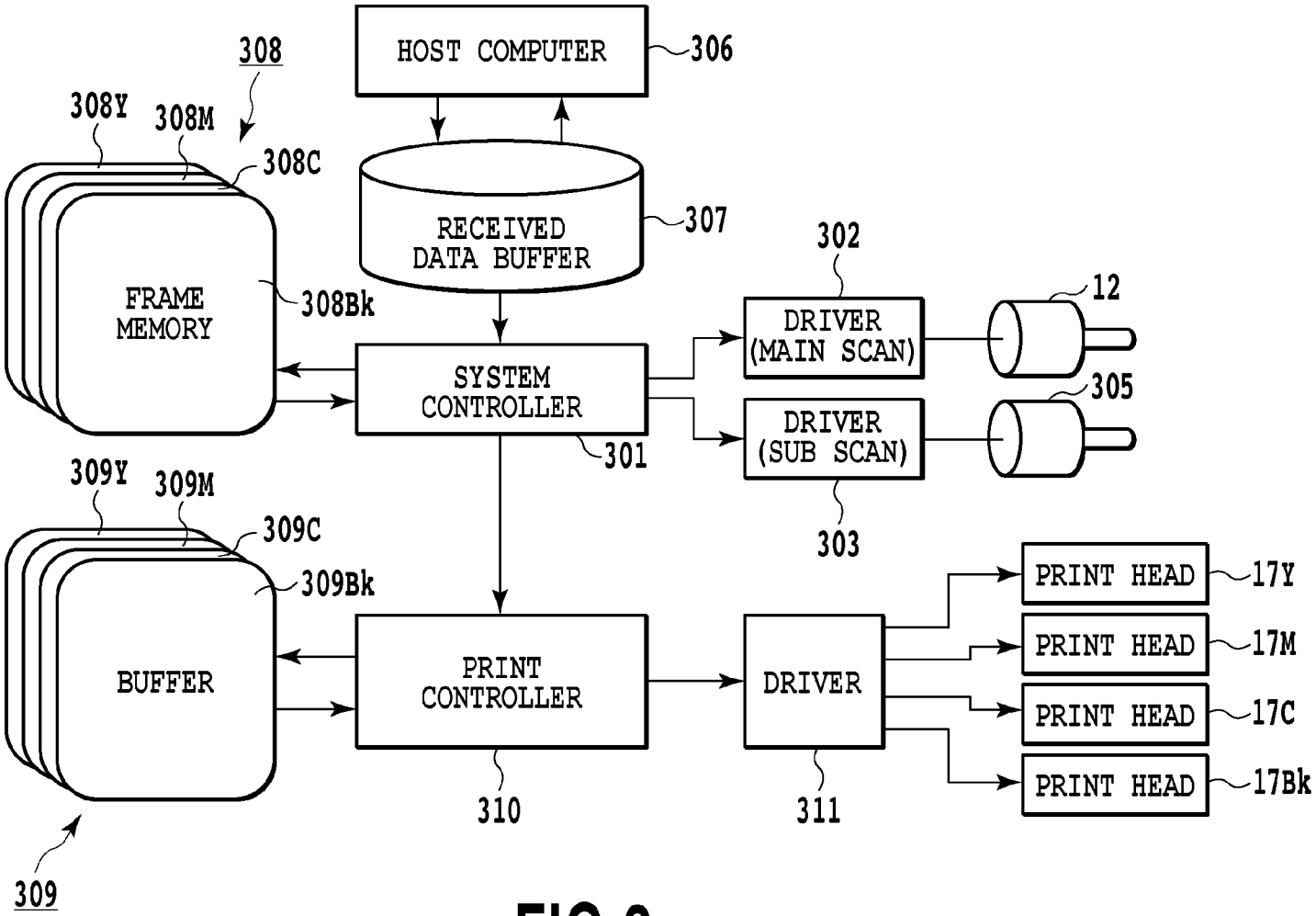
FIG. 3 is a block diagram mainly illustrating a control configuration of the inkjet printer illustrated in FIG. 1.

FIG. 3 is a block diagram mainly illustrating control configuration of the inkjet printer illustrated in FIG. 1. A printer of the present embodiment performs a series of printing operations on the basis of print data supplied from a computer 306 taken to be a host device. Herein, print data supplied from the computer 306 is data generated by a process later described with FIG. 4. Also, besides taking the form of the host computer 306 to be a computer given as an information processing apparatus as above, the form of the host computer 306 may also be taken to be an image reader or similar device.

A system controller 301 executes control of the printer overall, and is configured having a microprocessor (MPU) along with ROM storing a control program, for example. The ROM also stores information such as index patterns and master patterns described later. The carriage motor 12 produces drive for moving a carriage equipped with print heads as described above in the scan direction. A feed motor 305 drives conveying rollers such that a print medium is intermittently conveyed. The system controller 301 controls the drive of the motors 12 and 305 via respective drivers 302 and 303.

A received data buffer 307 stores multi-valued print data (the gradation data described later) received from the host computer 306, and temporarily stores the received multi-valued print data until the multi-valued print data is read by the system controller 301. Frame memory 308 (308Bk, 308C, 308M, 308Y) is memory for expanding the multi-valued print data (the gradation data described later) as binary print data (dot data), and has a memory size of a capacity required for printing for each ink color. Herein, the frame memory is memory able to hold an amount of data able to print one page's worth of a printed sheet, but obviously is not limited to this size. Buffers 309 (309Bk, 309C, 309M, 309Y) are memory elements for temporarily storing binary print data, and their storing capacity varies according to the number of nozzles in each color's print head.

While expanding and storing data in buffers as above, the system controller 301 performs a dot arrangement process using index patterns and a process for generating print data corresponding to each of a plurality of scans using masks, which are described later with reference to FIG. 7 and subsequent figures. The processes and controls by the system controller 301 are executed in accordance with a program stored in ROM.

A print controller 310 controls the print heads on the basis of commands from the system controller 301. More specifically, the print controller 310 controls a driver 311 to cause the print heads 17Bk, 17C, 17M, and 17Y to eject inks.

Figure 4:
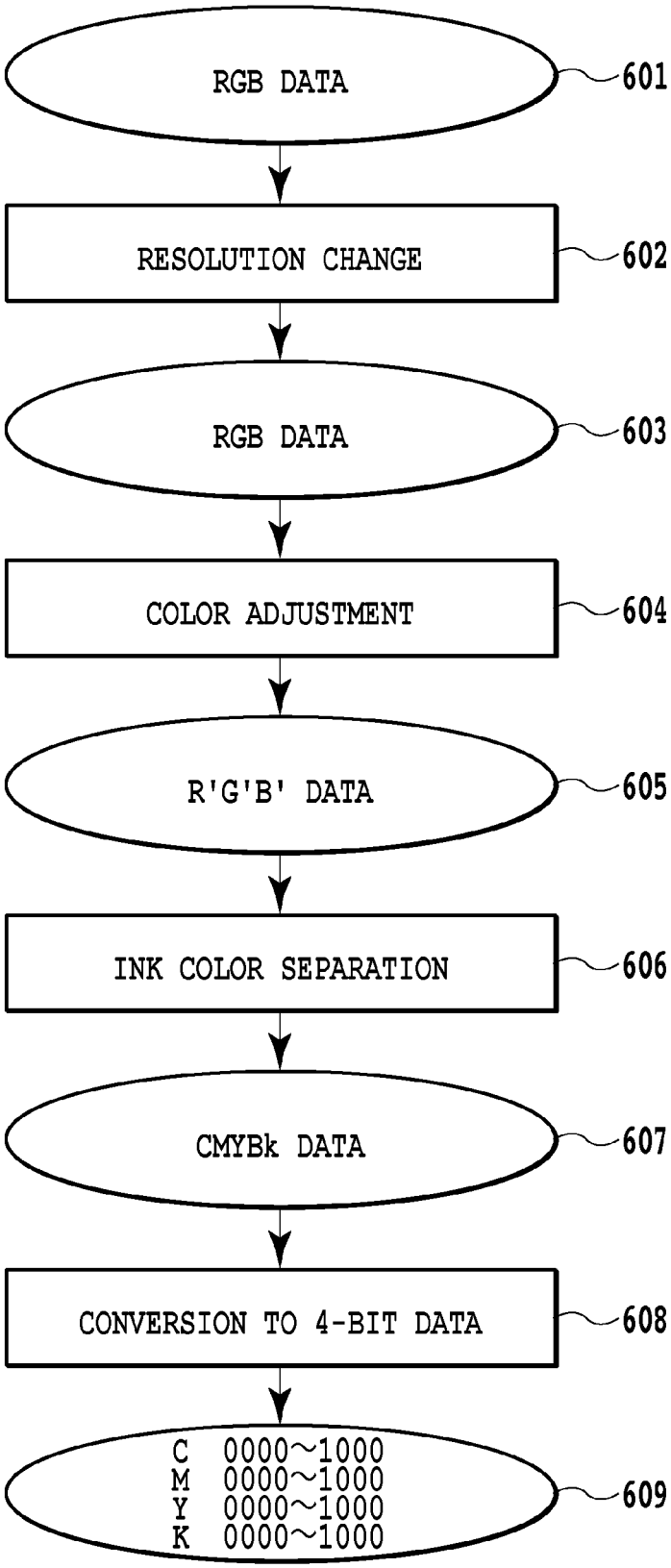
FIG. 4 is a block diagram explaining the generation of print data and supply of print data to a printer by the host computer illustrated in FIG. 3.
Figure 6A:
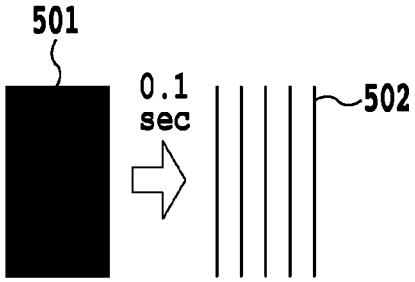
FIGS. 6A to 6E are diagrams for explaining the effects exerted on a print image by nozzle nonuse time during print head scanning.
Figure 6B:
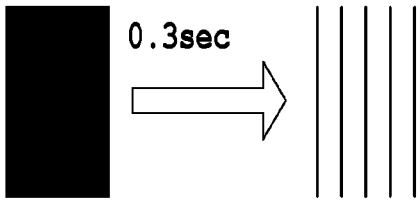
Figure 6C:
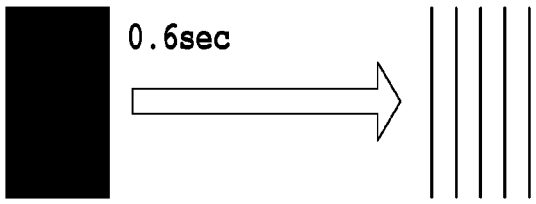
Figure 6D:
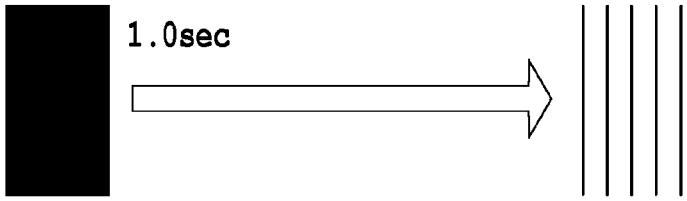
Figure 6E:
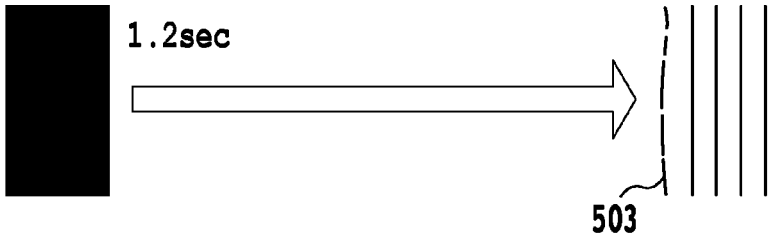

FIG. 4 is a block diagram explaining the generation of print data and supply of print data to a printer by the host computer 306 illustrated in FIG. 3. Herein, a printer driver is installed onto the host computer, and the processing illustrated in FIG. 4 is executed by the printer driver. As illustrated in FIG. 4, the printer driver acquires RGB data 601 from an application, etc. running on the host computer. A resolution conversion 602 is performed on the RGB data, and converted RGB data 603 is obtained. Subsequently, a color adjustment process 604 is performed on the converted RGB data 603. This color adjustment process is a process that converts the color space of the RGB data 603 into a color space expressible by the printer, for example. Next, an ink color separation process 606 is performed on the R'G'B' data 605 obtained with the color adjustment process 604. This color separation process is a process that determines data combinations corresponding to ink colors (Y, M, C, Bk) for realizing the colors expressed by the R'G'B' data 605 with the printer. In the CMYBk combination data 607 obtained with the color separation process 606, the individual colors CMYBk are each made up of 8-bit (256 gradations) data. Next, a quantization process is performed on the CMYBk combination data 607, and CMYBk quantized data (herein being data wherein the individual colors CMYBk are each made of 4 bits) is obtained. A known error diffusion process or dithering process, for example, may be used as the quantization process. This 4-bit data is the gradation data 609 with 9 gradation levels, and this gradation data 609 is sent to the printer as multi-valued print data.

FIGS. 5A to 5E are views explaining how an ejection failure occurs due to ink viscosity increasing. In these drawings, the respectively noted times are elapsed times since the time of the ink ejection before each respective ink ejection. As illustrated in FIG. 5A, since a nozzle immediately after ejecting ink is supplied with fresh (viscosity is not increased) ink inside the nozzle by a refill, fresh ink exists inside the nozzle. The states after respective elapsed times from this state without another ejection are the states illustrated in FIGS. 5B to 5E. As time elapses, water content gradually evaporates from the ink inside the nozzle. Thus, the ink grows richer in components other than water, and the ink viscosity rises. When 1.2 sec elapse and the viscosity of the ink exceeds the normally eject-able viscosity, the ink ejection volume decreases, the ink ejection direction is deflected, and may even result in a ejection failure, for example, as illustrated in FIG. 5E.

FIGS. 6A to 6E are diagrams for explaining the effects exerted on a print image by nozzle nonuse time during scanning of print head. These drawings illustrate differences in the printed results of thin lines in the case of printing the thin lines after a nozzle nonuse period elapses immediately after printing a solid image. First, a solid image 501 is printed. This image is printed with one scan of the print heads from the left side to the right side of the drawing, and is the output of what is called a one-pass printing. Immediately after printing the solid image 501, thin lines 502 are printed after 0.1 sec, a comparatively short amount of time, elapses. Since a viscosity of ink in the respective nozzles of the print heads is not increased, favorable printed results are obtained for the thin lines 502. In contrast, thin lines 503 are printed after 1.2 sec, a comparatively long amount of time, elapse since printing the solid image 501. For these thin lines 503, since the viscosity of ink inside the nozzles is increased, the thin lines intended by the image data cannot be printed. In the case of significant ink viscosity increasing, ejection failure may even result. As illustrated in the drawings, since normal ejection still occurs for nozzle nonuse times up to 1 sec, it is assumed that the time until ink viscosity increasing is 1 sec in this example. However, since the time until ink viscosity increasing depends on the ink components, obviously the above time may change if the ink components change.

First Embodiment

A first embodiment of the present invention generates print data for each pass in a multi-pass printing, such that the ratio of dots consecutively formed by the same nozzle during the same scan becomes greater in low-density image areas than in high-density image areas. Thus, the lengthening of nozzle nonuse time can be suppressed, even in the case of printing a low-density image in which ink viscosity increasing easily occurs due to the lengthening of nozzle nonuse time. As a result, degraded image quality due to ink viscosity increasing is reduced. More specifically, print data used for each scan of a multi-pass printing is generated from print data corresponding to dots to be formed in a pixel line area, so that the ratio of dots formed continuously by the same nozzle during the same scan from among the dots formed in a low-density image area of a given density or less is greater than the ratio of dots formed continuously by the same nozzle during the same scan from among the dots formed in a high-density image area greater than the given density. Herein, a multi-pass printing is a technique of causing print heads to scan plural times across the same pixel line area on a print medium, while also printing onto the print medium by associating different nozzles with the same pixel line area among the plural scans.

Masks

In the present embodiment, masks are used to divide print data corresponding to a pixel line area and generate print data used for each of a plurality of scans in a multi-pass printing.

Figures 7A, 7B:
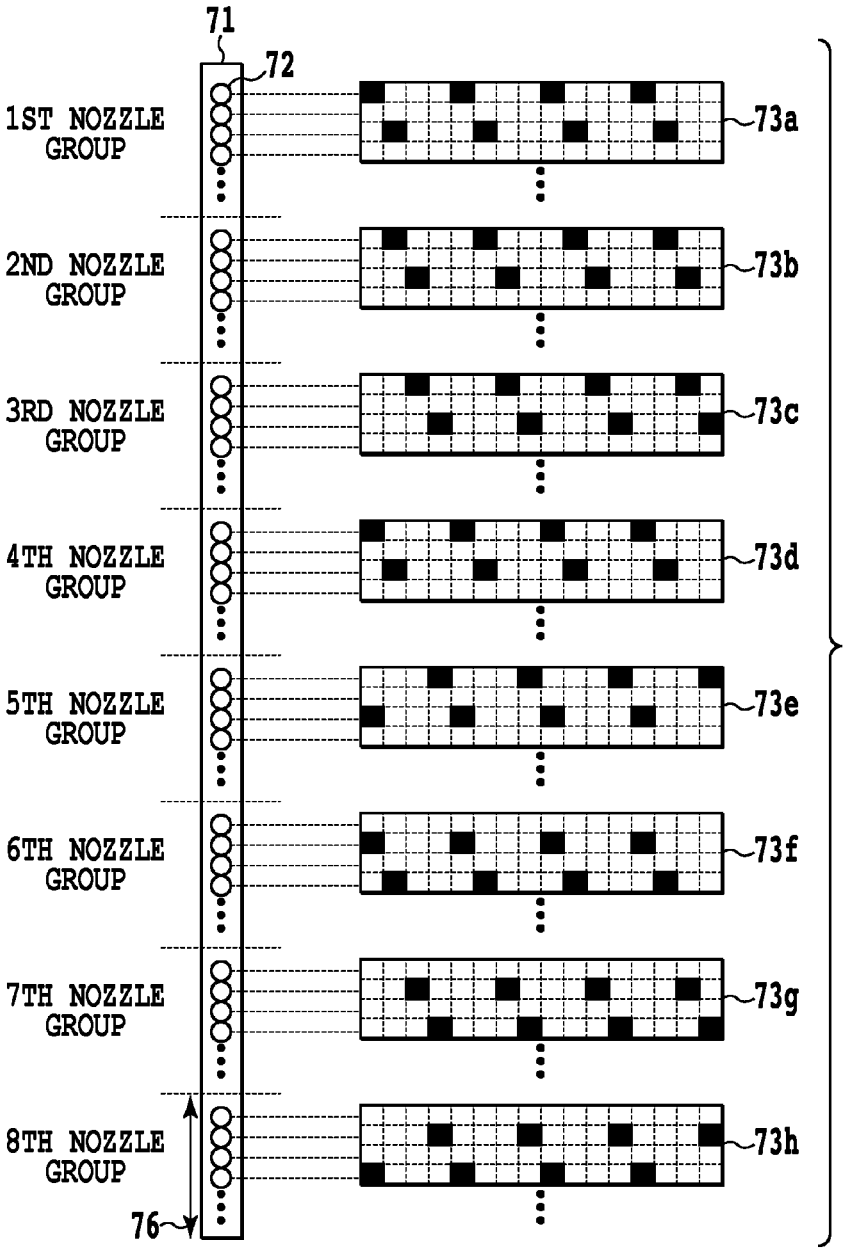
FIG. 7A is a diagram illustrating a mask for a single ink color used in 8-pass printing that completes printing in eight scans (passes)
FIG. 7B is a diagram illustrating, for the case of a given image in the area of the mask pixels indicating "output" in the mask pattern illustrated in FIG. 7A, the cycle number of the scan (pass) in which individual pixels in that image are printed by the mask pixels indicating "output"

FIG. 7A is a diagram illustrating a mask for a single ink color used in 8-pass printing that completes printing of respective pixel line areas in eight scans (passes). In the present embodiment, the mask illustrated in FIG. 7A is used for all ink colors. The 8-pass printing will now be explained, but obviously multi-pass printing to which the present invention is applicable is not limited to 8-pass printing. The present invention is also applicable to N-pass printing (where N is an integer equal to 2 or greater), such as 2-, 3-, 4-, and 16-pass printing. Also, in order to simplify explanation, unidirectional printing that only prints during scans of the print heads in one direction will be described as an example, but obviously the present invention can also be applied to bidirectional printing.

As illustrated in FIG. 7A, the 1280 nozzles on a print head are divided into eight that is 1st through 8th nozzle groups. The mask includes eight different patterns 73*a* to 73*h* corresponding to the respective nozzle groups. These eight patterns 73*a* to 73*h* corresponding to the eight nozzle groups are mutually complementary, and thus by overlaying print data for each pass generated on the basis of the eight patterns, it is possible to complete printing of an area having a width equal to the nozzle line length corresponding to a single nozzle group (i.e., the same area).

Among the mask pixels indicated by grid squares in each pattern, a mask pixel group on a single horizontal row corresponds to a single nozzle. Also, among these mask pixels, the mask pixels shaded black indicate that the print data for the pixels corresponding to those mask pixels is taken to be "output" data, whereas white mask pixels indicate that the print data for the pixels corresponding to those mask pixels is taken to be "non-output" data. The mask is realized by binary data made up of "1"s expressing "output" and "0"s expressing "non-output", and by taking the logical product between binary print data as described later, the binary print data is masked. Since the mask pattern herein is only 16 pixels wide whereas actual images are even wider, the same mask pattern is repeatedly applied. Also, in FIG. 7A, only four nozzles' worth of the mask area is illustrated for each nozzle group for the sake of convenience. In practice, however, there is 160 nozzles' worth of mask area for each nozzle group.

Each time a single scan print based on print data generated using the above mask is performed, the print medium is conveyed in the upwards direction of the drawing by the length indicated by the reference numeral 76. This length is equivalent to the nozzle arrangement range of a single nozzle group. Thus, an image to be printed in the same area is completed in eight scans. More specifically, the 8th nozzle group is used to print during the first scan, the 7th nozzle group is used to print during the second scan, and thereafter the nozzle group that is used is similarly changed and printing to the same area is completed in a total of eight scans.

FIG. 7B is a diagram illustrating individual mask pixels indicating "output" in the mask pattern illustrated in FIG. 7A which are expressed in number of the scan (pass) in which printing is performed by that those mask pixels indicates "output". Herein, FIG. 7B similarly illustrates a mask pattern corresponding to four nozzles' worth. For example, a mask pixel denoted by "1" means that printing by that mask pixel indicating "output" is allowed on the first pass. In other words, the mask pixels denoted by "1" correspond to the mask pixels shaded black in the mask of the pattern 73*h* used for the first pass printing of the same area given above.

Index Patterns

In the present embodiment, index patterns (also called "dot arrangement patterns") are used to determine positions where to eject ink (positions where to form dots). As described earlier with FIG. 4, 4-bit gradation data is sent from a host device to a printer as multi-valued print data. This gradation data is data that specifies numerical values (index values; gradation values) from 0 to 8. Then, at the printer, a dot expansion (hereinafter called an "index expansion") like that illustrated in FIG. 8 is performed by converting the gradation data transferred from the host device into dot arrangement patterns (index patterns) corresponding to the gradation values of that gradation data. Thus, binary print (ejection) data is generated, in which dot on/off states are defined for respective groups of 4 pixels horizontally by 2 pixels vertically. This index expansion is performed in conjunction with a binarization process and a dot arrangement determination process. In this way, index patterns are made up of pixel matrices constituted by n horizontal by m vertical pixel groups. Herein, at least one of n and m is an integer equal to 2 or greater. By using these index patterns, the quantity of print data (gradation data) transferred from a host device can be reduced.

The dot arrangements can also be modified when index patterns (dot arrangement patterns) are used. For example, the dot arrangements just as illustrated in FIG. 8, as well as dot arrangements obtained by inverting those dot arrangements in the horizontal direction of the drawing, may be used. This is a process performed by the system controller 301 (FIG. 3) in the case of the present embodiment, and is called index rotation.

Herein, in the present specification, an area having a number of dots formed inside a given area that is greater than a predetermined number (in other words, an area of density higher than a predetermined density) is called a "high-duty (high density)" area. In contrast, an area having a number of dots formed in the given area that is less than or equal to the predetermined number (in other words, an area of density lower than the given density) is called a "low-duty (low density)" area.

Attunement Between Mask and Index Patterns

By associating mask and index patterns with each other described above, ink can be continuously ejected from the same nozzles during respective scans in multi-pass printing in the case of printing an image with a low-density area that is lower than a predetermined density. More specifically, dot data to be printed during a single scan is obtained by taking the logical product between the binary print data (dot data) and the data indicating "output" in the mask on a per-pixel basis. An attunement process like that below is performed for this process. Dot (binary) data for each pixel is generated using index patterns and a mask correspondingly to a nozzle. In this generation, the arrangement pattern of mask pixels indicating "output" in the mask used to generate the binary data is made have periodicity in the scan direction, as illustrated in FIG. 7A. Furthermore, the period of this mask pixel arrangement pattern is made be the same as the period of dot arrangements of the index pattern (the period in which index patterns are used). Herein, the relationship between the period of a mask pixel arrangement and the period of a dot arrangement of an index pattern is not limited to this example, and the mask pixel arrangement pattern period may also be 1/nth (where n is a natural number) of the period of an index pattern dot arrangement period.

By using a mask in which an arrangement pattern of mask pixels indicating "output" is determined as described above, the ratio in which dot data of a pixel line area corresponding to respective nozzles is printed during the same scan can be increased. As a result, the lower the density of printing is, the higher the ratio in which dots are continuously formed by ink ejection from a single nozzle during a single scan is. In other words, when printing a given image, the ratio in which dots adjacent to each other in the scan direction are formed by the same scan can be made higher for images of low density than for images of high density. Hereinafter, this will be explained in further detail.

Figure 9:
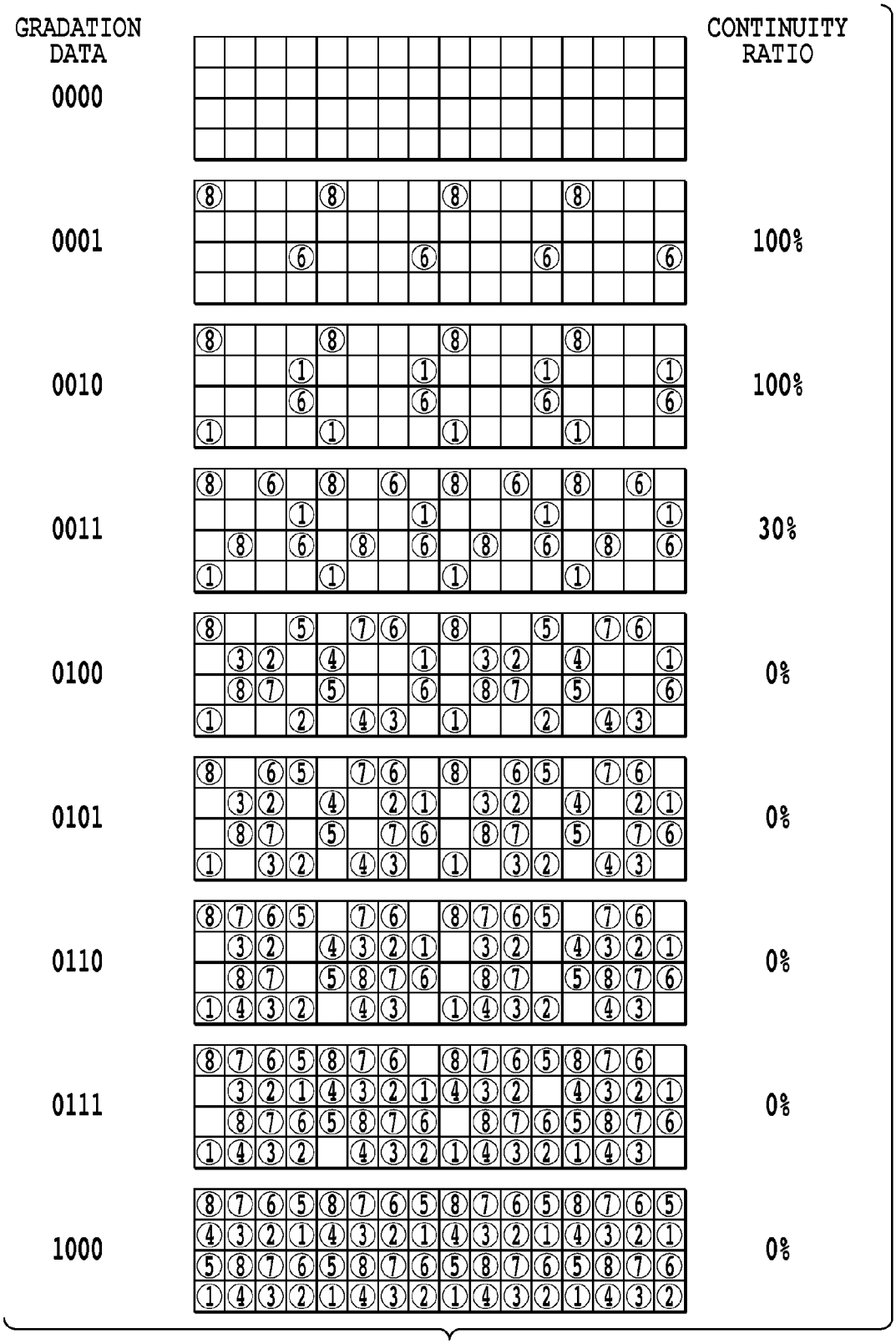
FIG. 9 is a diagram illustrating an exemplary index rotation in accordance with a first embodiment, and the relationship between an arrangement of dots and scan cycles that print those dots.

Regarding masks, the case of using the mask described above with FIGS. 7A and 7B will be described. For this mask, the index patterns (dot arrangement patterns) illustrated in FIG. 8 are used. FIG. 9 is a diagram illustrating specific patterns that have been used to the mask and an index rotation. More specifically, FIG. 9 illustrates the dot arrangements of the index patterns as arrangements of circled numbers, which indicate the scan during which the respective dots are printed when the mask described with FIGS. 7A and 7B are used to generate print data for each scan.

As illustrated in FIG. 9, 4 pixels horizontal by 2 pixels vertical index patterns can be specified by 4-bit gradation data. In FIG. 9, pixels indicated with a circled number are pixels where dots are arranged. In the drawing, the 4 pixels horizontal by 2 pixels vertical index patterns are repeated four times horizontally (equivalent to the scan direction) and two times vertically. This represents the index rotation, and the 16 pixels horizontal by 4 pixels vertical block represented by this rotation is repeatedly used. In this way, index patterns made up of 8 pixels have a periodicity in the scan direction, with 4 pixels horizontal by 2 pixels vertical being taken as one period.

Then, if the mask illustrated in FIGS. 7A and 7B is used to generate print data for each pass with respect to the index patterns described above, the respective dots in the 4 pixels horizontal by 2 pixels vertical of the index patterns are printed during the scan indicated by their respective numbers.

In FIG. 9, in the case of the dot arrangement pattern whose gradation data is the "0010", then in the respective pixel lines in the scan direction, the dots formed during the eighth pass, the first pass and the sixth pass, respectively, are consecutive in the scan direction. Thus, ink is continuously ejected from the nozzles that print those pixel lines. Also, this example is an example wherein the continuity ratio is 100%. On the other hand, in the case of the dot arrangement pattern whose gradation data is the "0011", then dots in the uppermost pixel line, for example, are printed alternately during the eighth pass and the sixth pass. Also, in the second pixel line from the top, dots formed during the first pass are consecutive. In the case of such a dot arrangement pattern, the continuity ratio, whose definition is described later, becomes 30%. Similarly, in the case of the dot arrangement pattern whose gradation data is the "0100", the continuity ratio becomes 0%.

In the above example, in the case where the print image density is comparatively low (when the gradation data is "0010", for example), the continuity ratio becomes 100%, and ink is continuously ejected from a single nozzle during each scan. As a result, it is possible to suppress ink viscosity increasing from occurring in that nozzle during a scan. Also, in the case where the gradation value data is "0011" with a continuity ratio of 30% indicated in the above example, dots in the uppermost pixel line are alternately printed during the eighth pass and the sixth pass, but the dots in each pass are formed at the same pixel interval as in the case of a 100% continuity ratio. In other words, even when the continuity ratio indicated in the above example is 30%, ink is ejected at the same time interval as the 100% case from each nozzle (of each pass) that prints dots on the uppermost pixel line, and ink viscosity increasing in the nozzle can be suppressed similarly to the case of a 100% continuity ratio.

Figure 20:
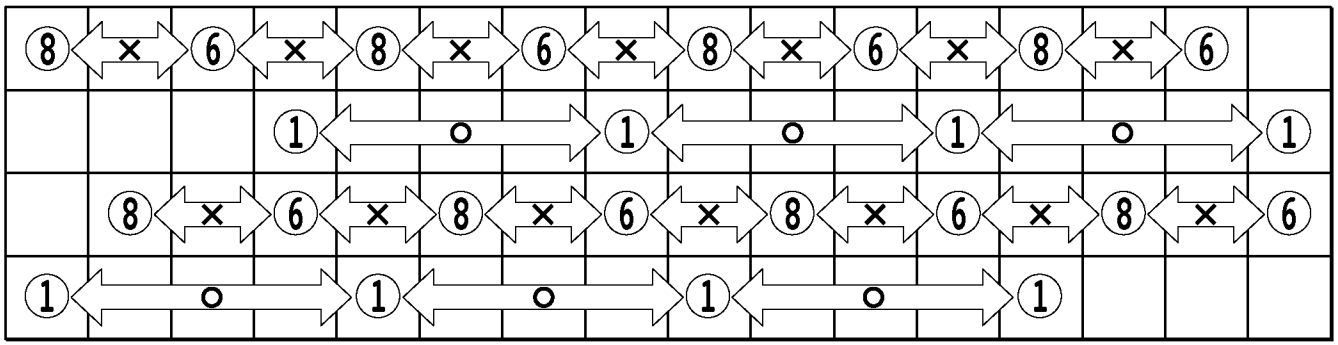
FIG. 20 is a diagram explaining a continuity ratio in accordance with a first embodiment of the present invention.

The definition of the term "continuity ratio" used in the above description will be explained. FIG. 20 is a diagram that explains continuity ratio. The example in FIG. 20 illustrates a dot arrangement printed when the mask in FIGS. 7A and 7B is used on the dot arrangement pattern for "0110" gradation data illustrated in FIG. 9. Also, in FIG. 20, "O" and "X" illustrated between the circled numbers which indicate scan have the following meanings. An "O" is illustrated in the case where adjacent dots to each other are formed during the same pass, whereas an "X" is illustrated when this is not the case. In the print dot arrangement of shown example, there are 6 "O" marks and 14 "X" marks. In other words, since the ratio of "O" marks is 30%, the continuity ratio is 30%.

FIG. 10A is a diagram illustrating an exemplary index pattern that has low attunement with the mask illustrated in FIGS. 7A and 7B. Also, FIG. 10B is a diagram illustrating an arrangement of dots and a scan that form those dots when using the index pattern illustrated in FIG. 10A. As illustrated in FIG. 10B, no dots are continuously formed during the same scan on any of the pixel lines. This means that ink is not continuously ejected from the same nozzle. In other words, the continuity ratio is 0%, as demonstrated from the definition of continuity ratio explained with FIG. 20.

Figure 21:
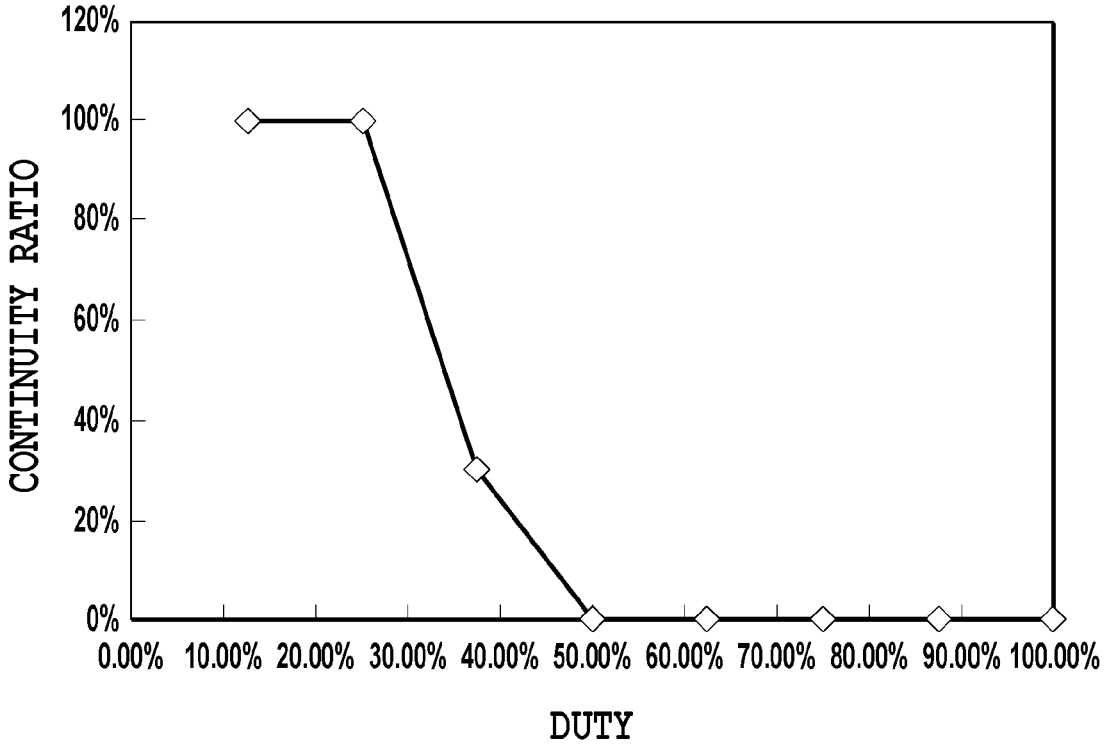
FIG. 21 is a diagram explaining the relationship between continuity ratio and print duty in accordance with a first embodiment of the present invention.

As the foregoing explanation demonstrates, according to the present embodiment, the lower the print duty is, the higher the probability that dots will be formed continuously during the same scan is. In contrast, the higher the print duty is, the lower the probability that dots will be formed continuously during the same scan is. For example, the index pattern for "1000" gradation data illustrated in FIG. 9 has 100% print duty, or in other words, is a dot arrangement in which dots are arranged at all pixels. FIG. 11 is a diagram illustrating the relationship between the dot arrangement in this case and the passes (scans) that form those dots in the case of using the mask illustrated in FIGS. 7A and 7B on that dot arrangement. As illustrated in FIG. 11, in the case of 100% print duty, the probability that dots will be continuously disposed during the same pass decreases to be 0. For example, in the uppermost pixel line in FIG. 11, respective dots are formed during the eighth pass, seventh pass, sixth pass, fifth pass, - - - , in that order starting from the pixels on the left side, and dots consecutive in the scan direction are formed during different passes. FIG. 21 is a graph illustrating the relationship between continuity ratio and print duty in the index patterns in FIG. 9. As illustrated in FIG. 21, the continuity ratio increases with lower print duty.

As described above, ejection failure may occur in the case of a long elapsed time since performing ink ejection in a nozzle. For example, in the case of a print head scanning from the left side of a print medium, irregular image due to ejection failure may be printed on the right edge if no print image exists in the middle of the print medium.

Figure 12A:
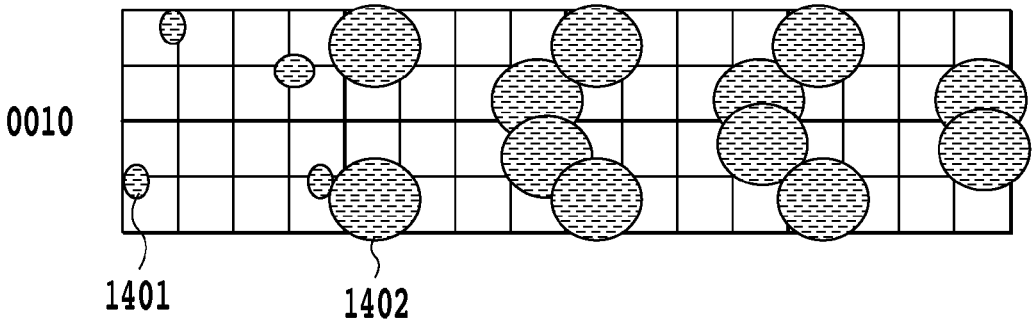
FIG. 12A is a diagram illustrating how dots are formed by printing in the present embodiment.

In contrast, in the present embodiment, printing is performed on the basis of the relationship illustrated in FIG. 9 between dot arrangements and the scans during which those dots are printed. FIG. 12A is a diagram illustrating how dots are formed by the above printing of the present embodiment. In FIG. 12A, reference numeral 1401 denotes an incorrectly landed dot and reference numeral 1402 denotes a correctly landed dot. As illustrated in FIG. 12A, among the dots printed during a single scan, the dots on the left edge portion are printed as a result of ejection being performed for the first time after a state in which ejection from the respective nozzles has not occurred. For this reason, some degree of ejection failure occurs, causing disorder in dot landing. However, since the area where such dots with incorrect landing positions exist is extremely narrow, image degradation is hardly noticeable.

Figure 12B:
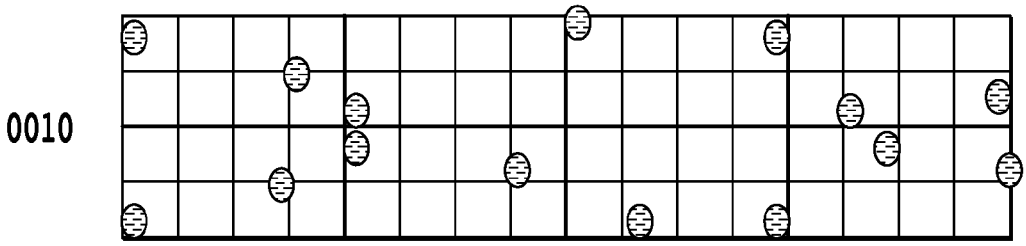
FIG. 12B is a diagram illustrating an arrangement of dots in the case where the mask and the dot arrangement are weakly attuned, and disorder in the printed dots when printing on the basis of passes that print those dots.

In contrast, FIG. 12B is a diagram illustrating a dot arrangement in the case where the mask and the dot arrangement have a low attunement as shown in FIG. 10B, and irregularity in dots that are printed on the basis of passes that print those dots. In this case, the ejection from each nozzle becomes a first ejection after a comparatively long nonuse time for every pixel in the scan direction, ejection failure occur throughout the scan area, and irregularity occurs in dots that are landing. As a result, irregular dots present throughout an image, and image degradation becomes noticeable.

Figure 12C:
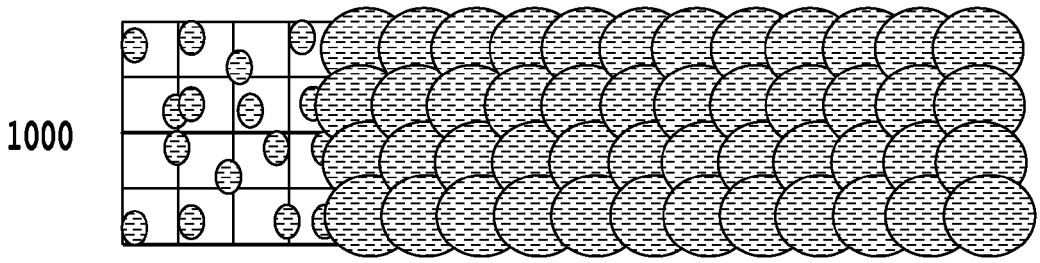
FIG. 12C is a diagram illustrating printing results based on the relationship between an arrangement of dots and passes that form those dots in the case of an image with a high duty as illustrated in FIG. 11 in accordance with the present embodiment.

FIG. 12C is a diagram illustrating printing results based on the relationship between a dot arrangement and passes that form those dots in the case of an image with a high duty as illustrated in FIG. 11 in accordance with the present embodiment. In this case, and similarly to the case illustrated in FIG. 12A, irregularity in dots that are formed is concentrated at the left edge portion where scans being. However, in this case, since the area where such dots with incorrect landing positions exist is extremely narrow, image degradation is hardly noticeable. Also, when given a high-duty image, even supposing the case where a dot arrangement is determined such that dots are consecutively formed at comparatively short intervals during the same scan, refilling cannot be satisfactorily performed with respect to the ejection frequency, resulting in the possibility of ejection failure. In the embodiment of the present invention, in the case of printing a high-duty image, ink is ejected at a longer interval than certain length during the same scan as illustrated in FIG. 11, thus inhibiting image degradation like the above.

Table 1 below illustrates the relationship between the continuity ratio in dot formation and print duty of image, and an evaluation of printed image quality. In Table 1, an "O" indicates favorable image quality, while an "X" indicates that degraded image quality is noticeable.

TABLE 1

| | | Duty | |
|---|---|---|---|
| | | Light | Heavy |
| Continuity ratio | High | ○ | X |
| | Low | X | ○ |

As illustrated in Table 1, in the case where the print duty is high, the first ink ejection during each scan is performed immediately, and thus the area of noticeable dot disorder is extremely small. For this reason, degradation as a printed image is not noticeable. In contrast, if ink ejection is continuously performed, image irregularity related to refilling may occur because the duty is high.

In contrast, for a low-duty image, if a printing of the prior art with low continuity is performed, then irregularity in the dots that are formed will extend over a large range, and thus image degradation will become noticeable. In contrast, if the continuity is applied, irregular dot formation can be reduced, and image degradation can be suppressed.

According to the method as described above, it becomes possible to reduce dot irregularity for all image duties and form favorable images. Also, such control is possible simply by attuning index patterns and a mask with each other as described earlier, and can be realized without increased costs, etc.

Herein, the attunement of a mask and index patterns described earlier is not limited to attunement between a mask and index patterns undergoing a rotation. For example, advantages resembling the above-described attunement process can be obtained if dot arrangements of per-gradation index patterns are determined so as to match the arrangement of mask pixels indicating "output" in a given mask pattern.

Second Embodiment

A second embodiment of the present invention relates to increasing the size of the mask illustrated in the first embodiment described above. In the present embodiment, the mask illustrated in FIG. 7B is taken to be a mask pattern A. This mask pattern is used together with a mask pattern B, a mask pattern C, and a mask pattern D respectively illustrated in FIG. 13. More specifically, these patterns are used repeatedly in the order A, B, C, D. Thus, the mask size becomes 64 pixels wide in the horizontal direction. In this case, when focusing on the uppermost line, for example, ejection will be performed during all passes. Thus, bias in which nozzles are used can be prevented and a uniform image can be printed.

Figure 14A:
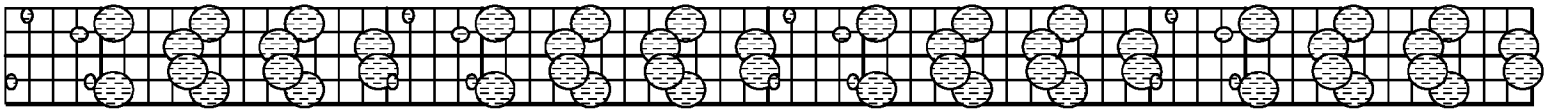
FIG. 14A is a diagram illustrating the results of printing 64 pixels of an image in the horizontal (scan) direction and in a dot arrangement given by the index patterns illustrated in FIG. 9 using the above masks.

Meanwhile, in the case of using such masks, image degradation may occur in some cases due to new nozzles being used when switching masks. FIG. 14A is a diagram illustrating the results of printing an image by using the above masks, which is of a dot arrangement given by the index pattern for the gradation value "0010" illustrated in FIG. 9 and is shown by 64 pixels of the image in the horizontal (scan) direction. On the other hand, FIG. 14B illustrates similar results in the case of applying the mask of the first embodiment described earlier (the mask in FIG. 7B).

Figure 14B:
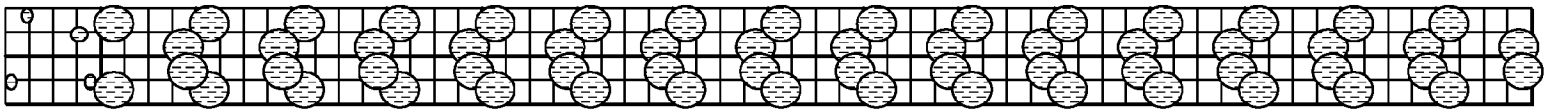
FIG. 14B is a diagram illustrating similar results in the case of applying the mask of the first embodiment discussed above.

Compared to the example illustrate in FIG. 14B, the example illustrated in FIG. 14A certainly has more incorrectly formed dots, but since the irregular dots are isolated in small areas, the dots are hardly noticeable. Also, since single lines of an image are formed using many different scans, the image becomes smoother.

Figure 14C:
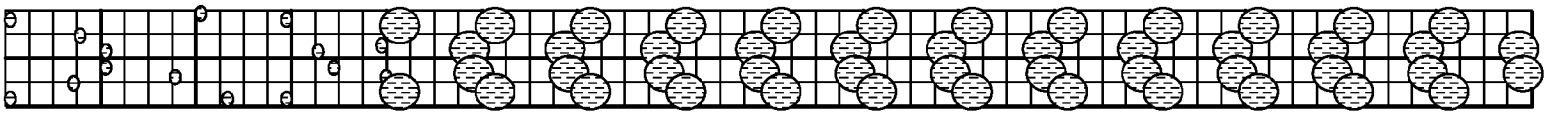
FIG. 14C is a diagram illustrating similar results in the case of the above-described weak attunement between a mask and a dot arrangement.

In contrast, FIG. 14C illustrates similar results in the case of the above-described low attunement between a mask and a dot arrangement. The example illustrated in FIG. 14C illustrates print results based on a dot arrangement obtained by repeating the mask pattern in FIG. 7B and repeating the index pattern illustrated in FIG. 10A. In this example, since 16 pixels' worth of dot formation is collectively made irregular at a density of 2400 dpi, there is obviously noticeable degradation in the printed image.

In the present embodiment, image degradation is not noticeable due to dispersing the image portions that become degraded over a wide range. Herein, four mask patterns are repeated, but the present embodiment is not limited to this number, and repeating masks may also not be used as long as there are consecutive timings when dots are formed. Also, by gradually shifting the mask pattern in the scan direction on a per-nozzle basis, incorrectly formed dots can be additionally isolated in the vertical direction.

Third Embodiment

A third embodiment of the present invention relates to a configuration that uses an ink set using light inks with lower color material concentrations than ordinary inks. In the present embodiment, light cyan and light magenta are respectively used. Light cyan and light magenta each has a lower color material concentration than the color material concentration of cyan ink and magenta ink, respectively.

In this way, in a printer that uses light inks, a typically bright image is printed by light inks and yellow ink. For this reason, low-duty images are often printed by light inks and yellow ink. Thus, the relationship between index patterns and a mask as explained in the first and second embodiments is applied only to the light inks and yellow ink. In contrast, such a relationship is not applied to other inks (dark inks), and dot arrangements and passes for printing that dots, which are effective at reducing image quality degradation caused by factors other than the above-described ejection failure (for example, bleeding by different colors of ink) are determined. Thus, since a variety of image quality degradation can be reduced, a favorable image can be obtained.

Also, the number of types of inks used and the inks to which dot arrangement attunement is applied is not limited to this example. For example, the above attunement may also be applied to just inks for which disordered dot formation readily occurs.

Fourth Embodiment

A fourth embodiment of the present invention relates to using a method of thinning-out with a fixed thinning pattern without using a mask as a method of distributing or dividing print data among plural passes in a multi-pass printing. This thinning-out with a fixed thinning pattern is a method of determining a dot arrangement such that pixels evenly spaced from each other by a given number of pixels on a pixel line are printed during the same scan. According to this method, by suitably setting the above interval, it becomes possible to perform faster scans.

FIG. 15A is a diagram illustrating, similarly to the mask pattern discussed above, the results of determining which scans form dots by thinning, using a fixed tinning pattern in accordance with the present embodiment. More specifically, this thinning configures the printing of dots during the same scan for every fourth pixel on respective pixel lines of an image to be printed. According to this print method, even if comparatively fast scans are performed, it is not necessary to raise the print head ejection frequency in accordance with the scan speed, and stable ejection becomes possible.

On the other hand, FIG. 15B is a diagram illustrating an exemplary mask that has no regularity to determine a dot arrangement such that dots formed at a fixed interval are formed by the same scan as described above. The ejection frequency in the case of using this mask can be computed as follows. Take the print resolution in the scan direction for this case to be $1/2400$ inch, for example. If the scan speed is taken to be 30 inch/sec, then ordinarily ejecting at an ejection frequency of 30×2400, or 72 kHz, would be required. In contrast, in the case of thinning with the pattern illustrated in FIG. 15A, ejection may be performed at ¼ frequency, or 18 kHz. Thus, printing can be performed at high scan speeds.

FIG. 16 is a diagram illustrating the results of distributing the dots among a plurality of scans by using the pattern illustrated in FIG. 15A, and illustrates a cyan dot arrangement as an example. FIG. 16 demonstrates that cyan dots are continuously formed during the same scan.

Herein, embodiments of the present invention relate to attuning a dot arrangement with pixel positions printable during a single scan, and continuously ejecting dots in a dot arrangement with comparatively low duty. For this reason, it should be obvious that an image forming method for each scan, which includes a method using a mask pattern and a fixed thinning pattern in which scans that form dots are associated with individual pixels, such as, is not limited to these methods.

Fifth Embodiment

A fifth embodiment of the present invention relates to using dither method as a dot arrangement determination method, and differs from the index patterns in the first through the fourth embodiments described above. The present embodiment generates dot (binary) data using a dither matrix, and uses a mask to distribute that dot data among a plurality of scans in a multi-pass printing.

Figure 17:
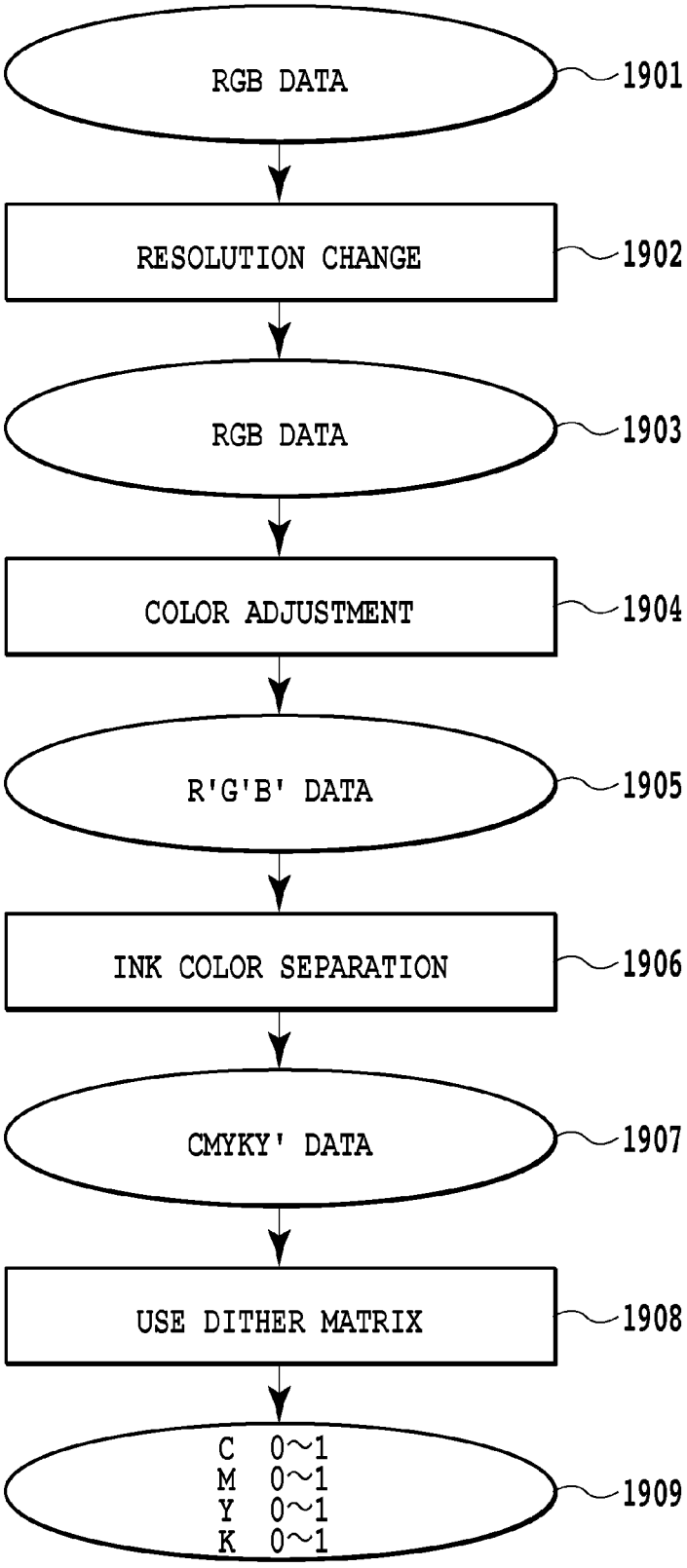
FIG. 17 is a block diagram for explaining a print data generation process that includes a binarization process using a dither matrix in accordance with a fourth embodiment of the present invention.

FIG. 17 is a block diagram for explaining a print data generation process that includes a binarization process using a dither matrix, and is similar to FIG. 4. The description of processes similar to those described with FIG. 4 is herein omitted or reduced. A dither process of the present embodiment uses a dither matrix 1908 to convert respective 8-bit C, M, Y, and Bk data generated by a color separation process 1906 into binary data 1909 for each color.

FIGS. 18A to 18E are diagrams explaining a dither process of the present embodiment. FIG. 18A illustrates a pattern of threshold values for each pixel in a dither matrix. For example, in the case of an image for which the input density information is 32 for all pixels, dots will be arranged at pixels corresponding to the pixels where the threshold value is 32 or less. FIG. 18B illustrates this dot arrangement. As FIG. 18B demonstrates, an input value of "32" yields a dot arrangement having a fixed regularity, similarly to the index patterns illustrated in FIG. 9. Similarly, FIGS. 18C to 18E illustrate dot arrangements for the case where the density information for all pixels is 64, 128, and 192, respectively.

FIG. 19A is a diagram illustrating a mask used in the present embodiment for the above dot arrangements. In this mask, the arrangement of mask pixels which are used during the same scans of a multi-pass printing and indicate "output" in the mask, correspondingly to a nozzle, is the same as the dot arrangements given by the above dither pattern.

FIGS. 19B to 19E are diagrams illustrating dots distributed among respective scans using the above mask and their continuity ratios for respective duties. As illustrated in FIGS. 19B to 19E, for the gradation number 32, for example, ink can be continuously ejected from the same nozzle during respective scans. In other words, the continuity ratio is 100%. The continuity ratios for the gradation numbers 64, 128, and 192 become 100%, 17%, and 5%, respectively, and the continuity ratio increases with lower duty. Thus, in the present embodiment, ink viscosity increasing due to nozzle idling can be suppressed, and thus it becomes possible to prevent lowered quality of a print image caused by ejection failure. Herein, a regular dither pattern and mask pattern are used for simplicity, but the present embodiment is not limited thereto.

Other Embodiments

Although the index expansion using index patterns and subsequent mask process described in the respective embodiments above are taken to be executed in an inkjet printer, all or part of these process may also be performed at a host device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-168483, filed Jul. 27, 2010, which is hereby incorporated by reference herein in its entirety.

What is claimed is:

1. An ink jet printing apparatus that performs plural scans of a print head, which has a plurality of nozzles for ejecting ink, over pixel line areas on a print medium and is able to form dots on the pixel line areas with the plural scans, said apparatus comprising:

a generation unit configured to generate print data used for each of the plural scans based on print data corresponding to dots to be formed on the pixel line area, so that a ratio of dots that are continuously formed on the pixel line area by a same nozzle in a same scan, out of dots formed for low density image area having densities equal to or lower than a predetermined density is higher than a ratio of dots that are continuously formed on the pixel line area by a same nozzle in a same scan, out of dots formed for high density image area having densities higher than the predetermined density.

2. The ink jet printing apparatus according to claim 1 that performs the plural scans of the print head, in which the plurality of nozzles for ejecting ink are arranged, over a same area on the print medium and forms dots on the print medium by making different nozzles correspond to the same area among the plural scans for printing, and wherein said generation unit includes:

a dot arrangement determining unit configured to determine arrangement of dots to be formed on the print medium for each of pixels, based on gradation data corresponding to density of an image; and a distributing unit configured to, by using a pattern of pixels to each of which scan for forming a dot on that pixel is made correspond, wherein a period of same scans arranged in a pixel line in a scan direction in the pattern is 1/nth (where n is a natural number) of a period of the arrangement of dots in the pixel line in the scan direction, distribute the dots, arrangement of which are determined, among respective scans that correspond to the pixel of that dot out of the plural scans.

3. An ink jet printing method of performing plural scans of a print head, which has a plurality of nozzles for ejecting ink, over pixel line areas on a print medium and of forming dots on the pixel line areas with the plural scans, said method comprising the steps of:

a generation step of generating print data used for each of the plural scans based on print data corresponding to dots to be formed on the pixel line area, so that a ratio of dots that are continuously formed on the pixel line area by a same nozzle in a same scan, out of dots formed for low density image area having densities equal to or lower than a predetermined density is higher than a ratio of dots that are continuously formed on the pixel line area by a same nozzle in a same scan, out of dots formed for high density image area having densities higher than the predetermined density; and a forming step of forming dots on the pixel line area with the plural scans according to the print data generated in said generation step.

4. The ink jet printing method according to claim 3 of performing the plural scans of the print head, in which the plurality of nozzles for ejecting ink are arranged, over a same area on the print medium and forms dots on the print medium by making different nozzles correspond to the same area among the plural scans for printing, and wherein said generation step includes:

a dot arrangement determining step of determining arrangement of dots to be formed on the print medium for each of pixels, based on gradation data corresponding to density of an image; and a distributing step of, by using a pattern of pixels to each of which scan for forming a dot on that pixel is made correspond, wherein a period of same scans arranged in a pixel line in a scan direction in the pattern is 1/nth (where n is a natural number) of a period of the arrangement of dots in the pixel line in the scan direction, distributing the dots, arrangement of which are determined, among respective scans that correspond to the pixel of that dot out of the plural scans.

5. An ink jet printing apparatus for forming image on a print medium by performing plural scans of a print head in a scan direction, the print head having a plurality of nozzles for ejecting ink, on an unit area of a print medium to form pixel line with dots in the scan direction, the pixel line corresponding to one nozzle, said apparatus comprising:

a generation unit configured to generate print data used for each of the plural scans, so that a ratio in a case that the ink jet printing apparatus forms an image of a first density is higher than the ratio in a case that the ink jet printing apparatus forms an image of a second density which is higher than the first density, the ratio being a ratio of the number of first dot of dots that are formed on the unit area to the number of the dots formed on the unit area, the first dot being formed in same scan as a scan for forming a nearest dot to the first dot, the nearest dot belonging to a pixel line to which the first dot belongs, and an ejection controlling unit configured to control the ejection of ink from the print head to the unit area according to the print data generated by the generating unit.

6. The ink jet printing apparatus according to claim 5, wherein the generation unit includes:

a first generation unit configure to generate a first print data which determines an arrangement of dots to be formed on the print medium for each of pixels by using index patterns, each of which is determined for a gradation corresponding to density of an image; and a second generation unit configure to generate a second print data which determines a scan during which a dot is formed among the plural scans by using mask patterns, wherein a length of the mask pattern in the scan direction is 1/nth (where n is a natural number) of a length of the index pattern in the scan direction.

7. The ink jet printing apparatus according to claim 5, wherein the generation unit generates the print data such that a predetermined nozzle among the plurality of nozzles ejects the ink at predetermined time interval in a case that the printing apparatus forms an image of the first density.

* * * * *